US006492890B1

(12) United States Patent
Woznlczka

(10) Patent No.: US 6,492,890 B1
(45) Date of Patent: Dec. 10, 2002

(54) METHOD AND APPARATUS FOR COOLING TRANSFORMER COILS

(75) Inventor: George Woznlczka, Chicago, IL (US)

(73) Assignee: Koninkijlike Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/522,748

(22) Filed: Mar. 10, 2000

(51) Int. Cl.[7] ..... H01F 27/08

(52) U.S. Cl. ..... 336/61; 336/65; 336/198; 336/208

(58) Field of Search ..... 336/65, 198, 192, 336/208, 61–60, 210, 55, 205, 206, 207, 185, 59

(56) References Cited

U.S. PATENT DOCUMENTS 4,020,439 A 4/1977 Thiessens et al. ..... 336/61
4,874,916 A * 10/1989 Burke ..... 219/10.75
5,469,124 A * 11/1995 O'Donnell et al. ..... 336/61
5,673,013 A * 9/1997 Moody et al. ..... 339/192
6,154,113 A * 11/2000 Murai ..... 339/198

FOREIGN PATENT DOCUMENTS

EP 0254132 A1 1/1988

* cited by examiner

*Primary Examiner*—Lincoln Donovan
*Assistant Examiner*—Kyung S. Lee

(57) ABSTRACT

One or more heat-conducting devices are located coincident with a bobbin that is used to form the coils of the transformer. The coil wire is subsequently wrapped around the bobbin and adjacent heat-conducting device assembly, using conventional coil winding techniques. The heat-conducting device is preferably configured to extend beyond the transformer so as to contact a heat-conducting surface, such as a ballast enclosure, when the transformer is appropriately mounted. Because the heat-conducting device is located adjacent the inner windings of the coil, which is typically the locale of the highest temperature build-up in a transformer, a highly efficient heat-transfer is achieved. Preferably, the heat-conducting device comprises one or more copper conductors, with a thin layer of insulating tape separating the copper conductors from the coil windings.

15 Claims, 2 Drawing Sheets

METHOD AND APPARATUS FOR COOLING TRANSFORMER COILS

BACKGROUND OF THE INVENTION

1. Field of the Invention

This invention relates to the field of electric transformers, and in particular to transformers that are used in ballast circuits of lamp assemblies.

2. Description of Related Art

Ballasts are commonly used in lamp assemblies to provide a preferred, or optimal, current and voltage to the lamp device. Most lamp ballasts employ a transformer to effect the required transformation of supply voltage to this preferred voltage. The reliability, or expected time-to-failure, of a transformer is inversely proportional to its operating temperature. Electric current flowing through the coils of the transformer generates heat, and this heat causes an increase in the operating temperature of the transformer, thereby reducing its reliability. The amount of heat generated can be reduced by using larger sized wires in each coil, but would result in a larger sized and more costly transformer. Alternatively, the operating temperature can be reduced by efficiently removing the generated heat from the transformer. A variety of techniques are currently available for increasing the efficiency of heat transfer from the coils of a transformer. Thermally conductive potting compounds have been used to conduct the heat from the transformer coils to an enclosure containing the transformer. These semi-fluid compounds, however, are somewhat difficult to handle, compared to solid devices and components, and often introduce reliability problems to other devices, for example, by flowing into the moving parts of switches, relays, connectors, and the like.

European Patent Application EP 0 254 132, filed Jul. 8, 1987, discloses fastening a metal shell about a transformer, wherein the shell preferably contacts the exterior layer of the coil windings, via a thin insulating layer. This shell is preferably connected to the ballast enclosure, to transfer the heat generated by the coils to the enclosure, both the shell and the enclosure being made of heat-conductive material. This exterior shell must be configured to allow air to circulate within the enclosure, else the thermal efficiency gained by providing the shell will be reduced by the reduction in radiant heat dissipation. Also, the wires that are connected to the coils must be routed through openings in the shell. To assure an efficient thermal contact between the shell and the coil, both the coil dimensions and the shell dimensions must be controlled. A loose fitting shell will be thermally inefficient, and a tight fitting shell may be difficult to fit onto the transformer.

BRIEF SUMMARY OF THE INVENTION

It is an object of this invention to provide a method of manufacturing a transformer that provides for efficient heat-transfer from the coils of the transformer. It is a further object of this invention to provide a method of manufacturing a transformer that provides an efficient heat transfer without introducing additional manufacturing constraints. It is a further object of this invention to provide a transformer that includes an efficient heat transfer arrangement.

These objects and others are achieved by providing one or more heat-conducting devices coincident with the plastic bobbin that is typically used to form the coils of the transformer. The coil wire is subsequently wrapped around the bobbin and adjacent heat-conducting device assembly, using conventional coil winding techniques. The heat-conducting device is preferably configured to extend beyond the transformer so as to contact a heat-conducting surface, such as a ballast enclosure, when the transformer is appropriately mounted. Because the heat-conducting device is located adjacent the inner windings of the coil, which is typically the locale of the highest temperature build-up in a transformer, a highly efficient heat-transfer is achieved. Preferably, the heat-conducting device is a thick copper conductor having a thin layer of insulating tape separating it from the coil windings.

BRIEF DESCRIPTION OF THE DRAWINGS

The invention is explained in further detail, and by way of example, with reference to the accompanying drawings wherein.

Throughout the drawings, the same reference numerals indicate similar or corresponding features or functions.

DETAILED DESCRIPTION OF THE INVENTION

This invention is based on the observation that the location of the hottest temperatures in a transformer is typically at its core area. That is, the wires at the innermost windings of a coil are subjected to the highest operating temperatures. Because the reliability of a transformer is dependent upon its operating temperature, the transformer must be designed for this highest temperature to achieve its specified or desired reliability performance. In accordance with this invention, the transformer is manufactured with a heat sink adjacent its core, to dissipate heat energy from the location that traditionally reaches the highest temperature. By lowering the peak temperature via this heat sink, the overall reliability of the transformer increases. From an alternative perspective, a reduction in peak temperature allows for the use of smaller wires or less costly insulation material while achieving the same reliability of a larger or more costly transformer that operates at a higher peak temperature.

Figure 1:
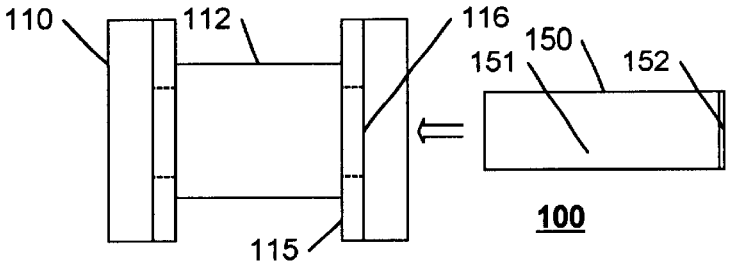
FIGS. 1–3 illustrates three views of an example bobbin assembly with integral heat sink in accordance with this invention.
Figure 2:
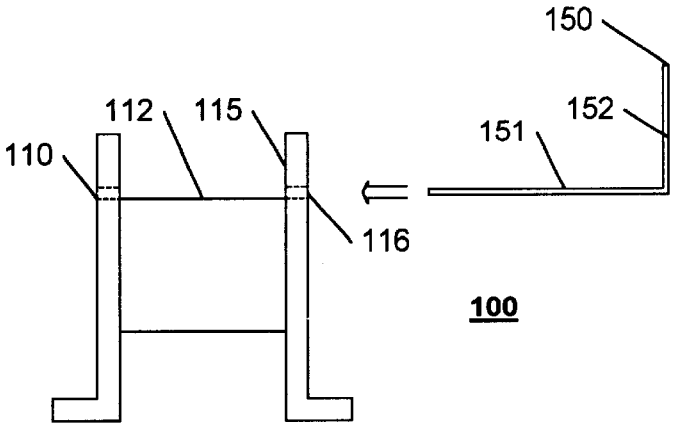
Figure 3:
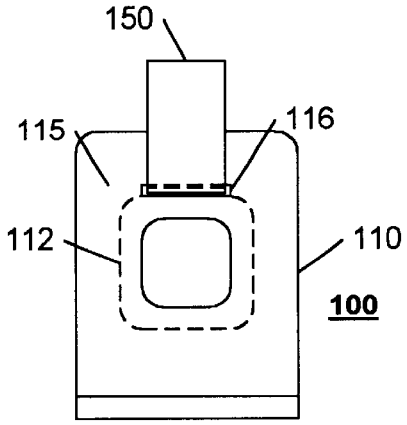

FIGS. 1, 2, and 3 illustrate a top, front, and side view, respectively, of an example bobbin assembly 100 with integral heat sink 150 in accordance with this invention. A bobbin 110 has a core 112 about which one or more wires are wound to form the coils of a transformer. Because some transformers are formed by adjoining multiple independent bobbins, some of which may have a single coil, this invention is presented in the context of a single or multiple coil bobbin, for ease of reference, and not intended to limit the scope of this invention. In a multiple bobbin transformer, one or more of the bobbins may be configured as a bobbin with integral heat sink in accordance with this invention. The winding of one or more coils on the common bobbin assembly 100 of this invention is well within the skill of one of ordinary skill in the art.

In accordance with this invention, a heat sink 150 is provided that is configured to lie adjacent the core 112 of the bobbin 110, so that the innermost windings of a coil (130 in FIGS. 4 and 5) will be laid upon the heat sink 150. The heat sink 150, as its name implies, is an efficient thermal conductor. In a preferred embodiment, the heat sink 150 is a copper conductor material that includes a thin insulating layer to provide electrical isolation from the windings of the coil. The heat sink 150 may be a single thermal conductor, or a laminate of multiple thermal conductors. Preferably, the heat sink 150 and bobbin 110 are configured for ease of assembly into the bobbin assembly 100. In the example bobbin assembly 100, the bobbin 110 has a flange 115 at each end of the core 112. The flange 115 contains a slot 116 into which the heat sink 150 is inserted. Any of a variety of other techniques can be employed to place the heat sink 150 adjacent the core 112, including merely holding the heat sink 150 adjacent the core 112 with one's hand until the first few windings of the coil are made, which serve to hold the heat sink 150 adjacent the core 112 thereafter. The heat sink 150 is configured to be wider than the width of the core 112, so that it extends beyond the coil area, and thereby provides a thermal path from the core 112 of the bobbin 110 to the area of the heat sink 150 beyond the coil area. The portion of the heat sink 150 that is intended to be adjacent the coil is labeled 151 in the figures, and the portion beyond the coil area is labeled 152. Depending upon the area or volume available when the transformer is mounted in its intended configuration, the region 152 may be sized so that airflow around the region 152 is sufficient to dissipate substantial heat energy via thermal radiation. Alternatively, as discussed further below, the region 152 may be configured so that it contacts another heat-conducting device, such as the shell of an enclosure, to provide additional surface area for this heat dissipation.

The bobbin assembly 100 is illustrated as comprising a single heat sink element 150, although it would be evident to one of ordinary skill in the art that multiple elements can form the heat sink 150. For example, a thermal conductor may be placed on each of the flats of the core 112, with thermal dissipation or conducting areas that fan out from this core region 112. In a more complex configuration, a thermal-conducting cylinder may be used as both the bobbin and the integral heat sink, or a thermal-conducting sleeve may be slipped over a single flanged bobbin (a "top-hat" bobbin), and so on.

Figure 4:
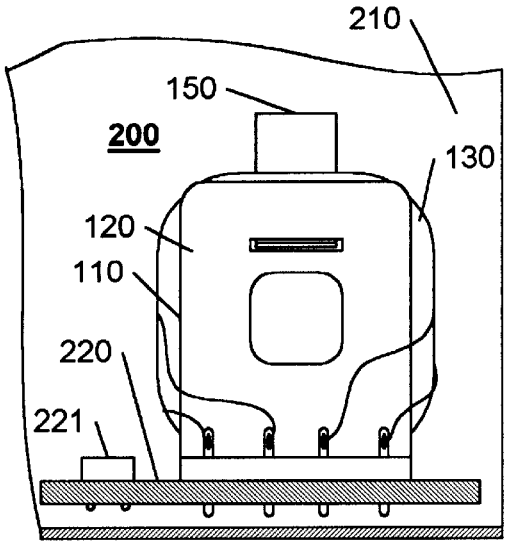
FIGS. 4–5 illustrates two views of an example ballast assembly with a transformer having an integral heat sink in accordance with this invention.
Figure 5:
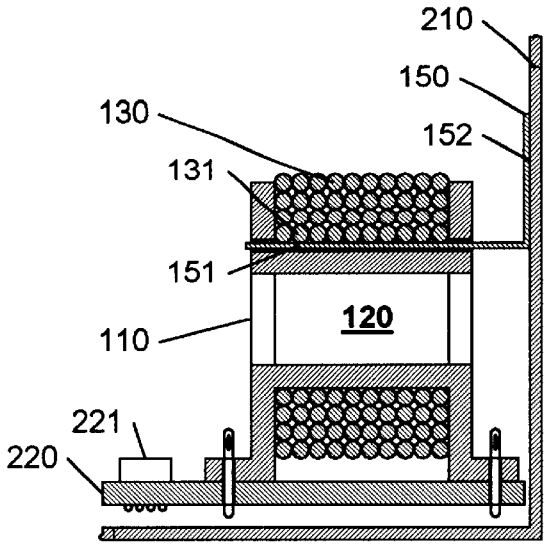

FIGS. 4 and 5 illustrate front and side view, respectively, of an example ballast assembly 200 with a transformer 120 having an integral heat sink 150 in accordance with this invention. The transformer 120 is illustrated with a coil 130 wound around the bobbin 110 and heat sink 150, such that the innermost winding 131 of the coil 130 is adjacent the heat sink 150. The transformer 120 is mounted on a printed circuit board 220, and interconnected via this printed circuit board 220 to other components 221 to effect the voltage transformation required of the ballast assembly 200. Typically, the ballast assembly provides a high frequency, high amplitude voltage to a lamp device, such as gas and/or vapor discharge lamps. The components 221 provide the switching functions to achieve the high frequency, and the regulation functions to control the voltage provided by the transformer 120 at various stages of the lamp's operation (pre-ignition, ignition, steady-state, etc.) for optimized lamp performance. Because of the high voltages involved, the ballast assembly 200 is typically enveloped by an enclosure 210, which is typically made of sheet metal. In a preferred embodiment of this invention, the portion 152 of the heat sink 150 that extends beyond the area of the coil 130 is configured to lie adjacent to a surface of the enclosure 210 when the transformer 120 is mounted in its intended location in the ballast assembly 200. In this manner, the heat sink 150 conducts heat from the coil 130 to the enclosure 210, thereby increasing the surface area from which this heat can be radiated, and thereby effecting a reduction in the operating temperature of the transformer 120. Any of a variety of techniques can be employed to optimize the conduction of heat from the heat sink 150 to the enclosure 210, such as applying a thermal-conductive paste to the portion. 152 of the heat sink 150 before the enclosure is affixed about the ballast assembly 200, and so on. As noted above, although a single element heat sink 150 is illustrated in the figures, multiple heat sink components may form the heat sink 150, and may extend, for example, to multiple surfaces of the enclosure 210, thereby further increasing the efficiency of the thermal transfer of heat from the coil 130 of the transformer 120.

The foregoing merely illustrates the principles of the invention. It will thus be appreciated that those skilled in the art will be able to devise various arrangements which, although not explicitly described or shown herein, embody the principles of the invention and are thus within its spirit and scope. For example, the heat sink of the current invention is placed at the innermost core of the windings. The choice of the relative location of coils on a transformer is often determined based on factors other than thermal conduction. For example, an innermost coil may not be a heat generating coil, and the heat sink may be better placed at the innermost windings of a second coil that is wound on the bobbin. In such an embodiment, the bobbin and first coil winding forms the "core" to which the heat sink is adjacent, and the winding of the second, heat generating, coil is placed upon this core with integral heat sink. These and other system configuration and optimization features will be evident to one of ordinary skill in the art in view of this disclosure, and are included within the scope of the following claims.

I claim:

1. A method of manufacturing a transformer, comprising:

providing a bobbin assembly having an integral heat sink, and winding a wire about the bobbin assembly to form a coil of the transformer wherein:

the integral heat sink is configured to lie within a winding of the coil, and to extend beyond an area occupied by the coil, to facilitate a heat transfer from the inner winding of the coil when the transformer is mounted in its intended operational configuration, the integral heat sink is configured as an "L" shaped device having two orthogonal surfaces, the bobbin assembly includes a bobbin having a core surface, a first surface of the two orthogonal surfaces of the integral heat sink being adjacent the core surface of the bobbin, and a second surface of the two orthogonal surfaces of the integral heat sink being configured to be adjacent a heat-conducting surface when the transformer is mounted in its intended operational configuration.

2. The method of claim 1, wherein the integral heat sink is configured to lie within an entirety of the coil.

3. A method of manufacturing a transformer, comprising:

providing a bobbin assembly that includes:

a bobbin having a core surface and a flange surface at an end of the core surface, the flange surface having a slot for receiving a heat sink, the slot being configured so as to locate the heat sink adjacent the core surface when the heat sink is inserted into the slot, inserting the beat sink into the slot, thereby forming a bobbin assembly with integral heat sink, and winding a wire about the bobbin assembly to form a coil of the transformer.

4. The method of claim 3, wherein the bobbin comprises a plastic material, and the integral heat sink comprises one or more copper conductors.

5. A method of assembling a ballast assembly comprising:

providing a transformer having an integral beat sink that extends beyond one or more coils of the transformer, the integral heat sink being within a winding of the one or more coils, mounting the transformer in the ballast assembly, providing a ballast enclosure that is configured to contact a surface area of the integral heat sink when the enclosure is affixed to the ballast assembly, and affixing the enclosure to the ballast assembly, wherein providing the bobbin assembly includes:

providing a bobbin having a core surface and a flange surface at an end of the core surface, the flange surface having a slot for receiving the heat sink, the slot being configured so as to locate the heat sink adjacent the core surface when the heat sink is inserted into the slot, and inserting the heat sink into the slot, thereby forming the bobbin assembly with integral heat sink.

6. The method of claim 5, wherein providing the transformer includes:

providing a bobbin assembly that includes the integral heat sink, and winding one or more wires about the bobbin assembly to form the one or more coils of the transformer, thereby forming the transformer having the integral heat sink.

7. The method of claim 5, wherein the integral heat sink is within an entirety of windings of the one or more coils.

8. A transformer comprising:

a bobbin, a heat sink, and one or more wires that arc wound around the bobbin and the heat sink to form one or more coils of the transformer, wherein the heat sink is within a winding of at least one coil of the one or more coils of the transformer, the heat sink includes a portion that extends beyond a coil area occupied by the at least one coil;

the bobbin includes a core surface; and the heat sink is configured as au "L" shaped device that includes:

a first surface on a portion of the heat sink that includes the coil area, and a second surface that is on the portion of the heat sink that extends beyond the coil area;

the first surface of the heat sink being adjacent the core surface of the bobbin; and a second surface of the beat sink being configured to be adjacent a heat-conducting surface when the transformer is mounted in its intended operational configuration.

9. The transformer of claim 8, wherein the portion of the heat sink that extends beyond the coil area is configured to facilitate a conduction of heat from the transformer to an adjacent thermal-conducting surface when the transformer is mounted in its intended configuration.

10. The transformer of claim 8, wherein the heat sink is within an entirety of windings of at least one coil of the one or more coils of the transformer.

11. A transformer comprising:

a bobbin, a heat sink, and one or more wires that are wound around the bobbin and the heat sink to form one or more coil of the transformer, wherein the bobbin includes a core surface and a flange surface at an end of the core surface, the flange surface having a slot for receiving the heat sink, the slot being configured so as to locate the heat sink adjacent the core surface when the heat sink is inserted into the slot.

12. The transformer of claim 11 wherein:

the bobbin comprises a plastic material, and the heat sink comprises one or more copper conductors.

13. A ballast assembly comprising:

a transformer having an integral heat sink that extends beyond one or more coils of the transformer, the integral heat sink being within a winding of the one or more coils, and a ballast enclosure that is configured to contact a surface area of the integral heat sink when the enclosure is affixed to the ballast assembly, a bobbin assembly that includes the integral heat sink, and one or more wires that are wound about the bobbin assembly to form the one or more coils of the transformer, thereby forming the transformer having the integral heat sink wherein the transformer includes:

a bobbin having a core surface and a flange surface at an end of the core surface, the flange surface having a slot for receiving the heat sink, the slot being configured so as to locate the heat sink adjacent the core surface when the heat sink is inserted into the slot, and the heat sink that is inserted into the slot, thereby forming the transformer with integral heat sink.

14. The ballast assembly of claim 13, wherein:

the heat sink comprises one or more copper conductors, and the ballast enclosure comprises a thermal-conducting sheet metal material.

15. The ballast assembly of claim 13, wherein the integral heat sink is within an entirety of windings of the one or more coils.

* * * * *